US005613616A

United States Patent [19]

Monus

[11] Patent Number: 5,613,616

[45] Date of Patent: Mar. 25, 1997

[54] CLOSURE MEMBER FOR BEVERAGE OR FOOD CONTAINERS

[76] Inventor: Donald T. Monus, 604 7th St., SE., Largo, Fla. 34641-2175

[21] Appl. No.: 450,049

[22] Filed: May 25, 1995

[51] Int. Cl.[6] ..... B65D 39/00

[52] U.S. Cl. ..... 220/791; 220/212.5; 220/712; 215/354

[58] Field of Search ..... 220/307, 212.5, 220/710.5, 711, 712; 215/354, 318, 320, 321, 355, 356

[56] References Cited

U.S. PATENT DOCUMENTS

| | | | |
|---|---|---|---|
| 2,019,402 | 10/1935 | Duffy | 215/354 X |
| 2,487,400 | 11/1949 | Tupper | 215/354 X |
| 3,144,950 | 8/1964 | Rosenheim | 220/212.5 |
| 3,335,901 | 8/1967 | Edwards | 220/307 X |
| 3,860,162 | 1/1975 | Schutz | 220/711 |
| 4,090,630 | 5/1978 | Wiedmer | 215/320 |
| 4,281,774 | 8/1981 | Mumford | 220/306 |
| 4,393,976 | 7/1983 | Maguire | 220/307 X |
| 4,640,429 | 2/1987 | Sandhaus | 215/320 |
| 5,253,780 | 10/1993 | Adado | 220/711 |
| 5,472,542 | 12/1995 | Wermund | 215/321 X |

*Primary Examiner*—Stephen Cronin
*Attorney, Agent, or Firm*—Joseph C. Mason, Jr.; Murray B. Baxter

[57] ABSTRACT

A container lid has a depending insert having a thickness sufficient to have a groove formed in its peripheral edge, and a beverage container has an annular, radially inwardly extending protrusion formed in it that snaps into the groove when the insert is inserted into the container. The connection is so strong that the lid will not separate from the container even when the cup is filled with a beverage or food and inverted. The lid includes a peripherally positioned handle that enables facile removal of the lid, and the interconnection between the lid and the container includes a double seal that inhibits the risk of spillage.

1 Claim, 5 Drawing Sheets

CLOSURE MEMBER FOR BEVERAGE OR FOOD CONTAINERS

BACKGROUND OF THE INVENTION

1. Field of the Invention

This invention relates, generally, to lids for beverage or food containers. More particularly, it relates to a lid having an insert that snaps into a container and is tightly secured thereto to inhibit inadvertent spilling.

2. Description of the Prior Art

In a well-publicized case, a customer of a fast food restaurant was scalded by hot coffee when the coffee spilled from a beverage container. Inventors have produced numerous container and lid designs over the years, but the art has not yet provided a container and lid combination that minimizes the chances that a hot beverage will be spilled inadvertently.

A 1906 patent to Kindig (822,895) discloses a bottle having a plurality of circumferentially and equidistantly spaced apart tabs integrally formed about its rim, and a closure means having a matching number of complimentarily formed latches that mate with the tabs. Since the tabs must be formed as a part of the bottle, this design increases the cost thereof.

A means for effecting sealing of a container in which the container is provided with a rim having a plurality of openings therein and a sealing cover is provided with a plurality of barbs for engaging such openings is disclosed in U.S. Pat. No. 3,892,327 to Leitz.

U.S. Pat. No. 1,127,993 to Hayworth discloses a construction somewhat like that of the above-mentioned Kindig invention. A plurality of circumferentially and equidistantly spaced apart gripping members are formed integrally with a bottle and project upwardly therefrom; each gripping member has a recess formed therein that captures a corresponding tab formed in a closure means. A special tool is needed to separate the lid from the bottle.

All of these earlier designs advanced the art at the time of their invention, but there remains a need for a design that enhances the grip between a container and its lid. Specifically, there remains a need for a design that provides a double seal between a container and its lid. In view of the prior art considered as a whole at the time the present invention was made, however, it was not obvious to those of ordinary skill in this art how the needed construction could be provided.

SUMMARY OF THE INVENTION

The longstanding but heretofore unfulfilled need for an improved container closure means having a double seal has now been met by an elegant design that includes a closure means with an insert having a peripheral groove that snap fittingly mates with an annular protrusion that is integrally formed in the interior cylindrical side wall of a container.

More particularly, the novel lid includes an insert of predetermined thickness and an annular groove of predetermined depth is formed in the peripheral edge of such insert. A mating annular protrusion or ridge formed in an interior side wall of a food or beverage container extends radially inwardly toward the center of the container and has a radial extent substantially equal to the depth of said groove. The lid, container and ridge are formed of a flexible, resilient material. Thus, each of said parts flexes momentarily as the insert is inserted into the container, i.e., as the ridge enters the groove, and said parts resume their respective positions of repose when the insert is fully seated within the container, i.e., when the ridge on the container is firmly seated within the groove formed in the insert. The grip therebetween is so tight that the lid will not separate from the container even when the container is filled with a beverage or a food product and inverted and shaken in an effort to loosen the lid.

A peripherally mounted handle enables facile removal of the lid when desired, and the lid is slightly domed to reduce the likelihood of spillage when the container has been over-filled.

Thus, it should be understood that a primary object of this invention is to provide a container and lid design that prevents inadvertent separation of a lid from a container.

Another object is to provide such a design that does not defeat intentional removal of the lid from the container.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
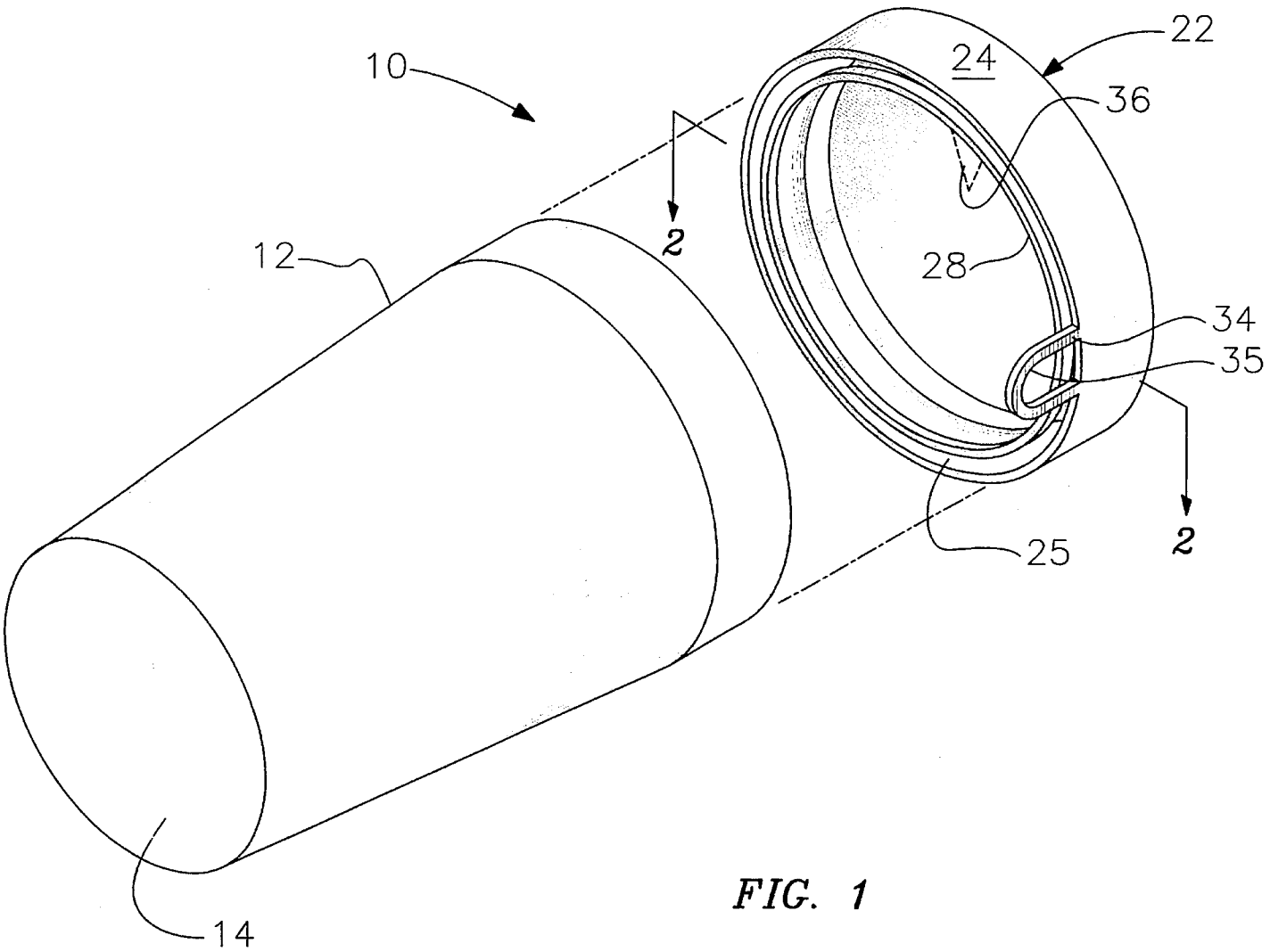
FIG. 1 is an exploded perspective view of a first embodiment of the novel lid and container.

Referring now to the Figs., it will there be seen that a first illustrative embodiment of the invention is denoted as a whole by the reference numeral 10. As depicted in FIG. 1, the novel structure has the appearance of a conventional fast food container and lid when the lid is secured to the container.

Figure 2:
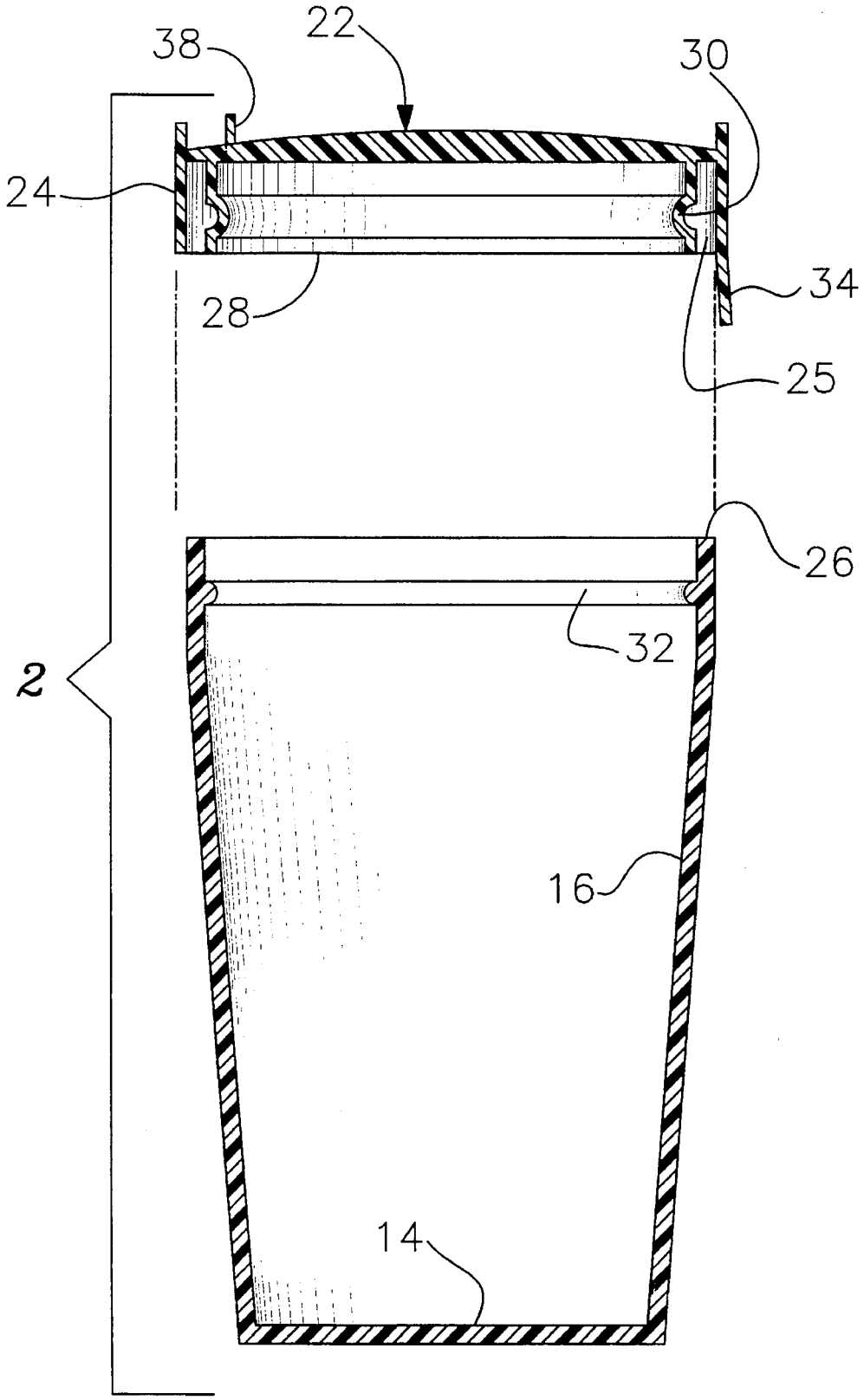
FIG. 2 is a sectional view taken along line 2—2 in FIG. 1.
Figure 3:
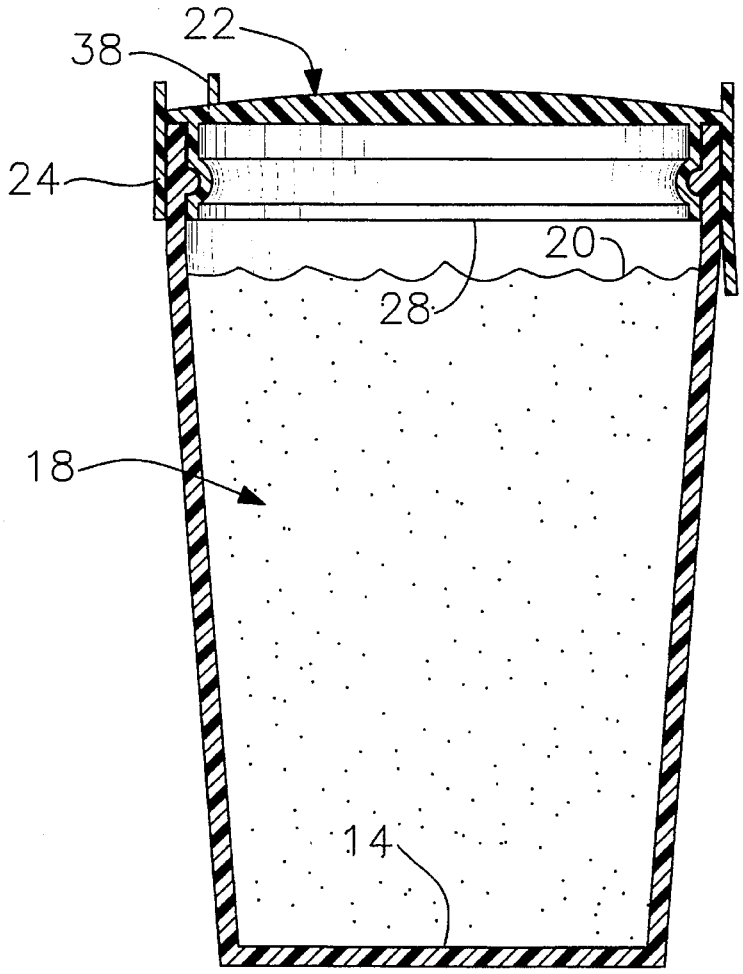
FIG. 3 is a sectional view of the container and lid of FIGS. 1 and 2 in their assembled configuration.

As best understood in connection with FIGS. 2 and 3, container 12 has a flat, imperforate bottom wall 14 of preferably circular configuration. Cylindrical side wall 16 is mounted about the periphery of said bottom wall 14 and projects upwardly therefrom, defining a beverage or food-holding cavity 18 in the well-known way. The beverage or food is denoted 20 sand may be any beverage or food at any temperature.

Lid 22 is slightly domed as depicted and includes a depending peripheral skirt 24 that frictionally engages the outer surface of rim 26 of container 12 in the well-known way.

Insert 28, which depends from lid 22 and which is positioned radially inwardly of skirt 24, has an annular groove 30 of predetermined depth formed therein. Note that insert 28 has a structure similar to that of depending skirt 24. More particularly, as indicated in the Figures, depending skirt 24 and insert 28 share a common thickness that is about the same thickness as cylindrical side wall 16 of container 12.

A radially inwardly extending ridge 32 of predetermined radial extent is formed in side wall 16 of container 12.

Note that ridge 32 is positioned downwardly a predetermined distance from rim 26 of container 12. The spacing is such that the bottom surface of lid 22 abuttingly overlies rim 26 when the lid is attached to the container as depicted in FIG. 3.

Figure 4:
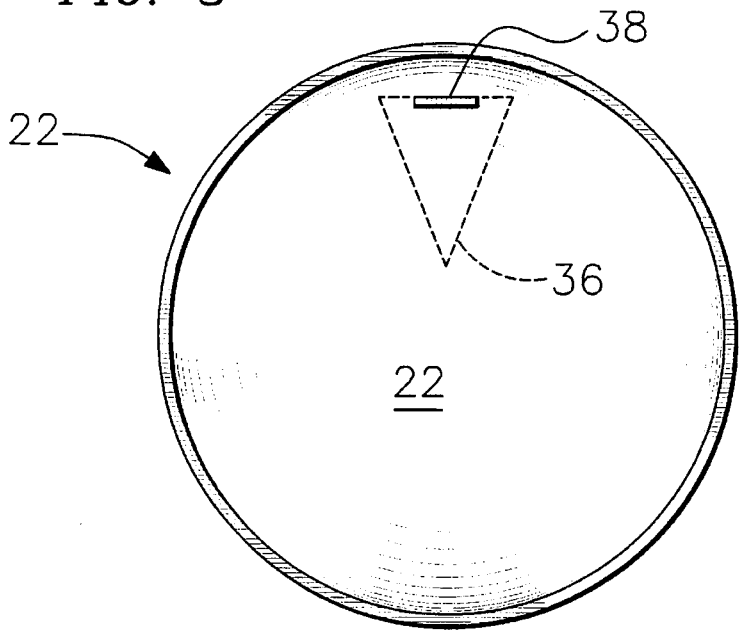
FIG. 4 is a top plan view of the first embodiment.

The annular space between insert 28 and depending peripheral skirt 24 is sized to snugly receive therebetween rim 26 of the container. In other words, the inner diameter of depending skirt 24 is substantially equal to the outer diameter of rim 26, and the outer diameter of insert 28 is substantially equal to the inner diameter of said rim 26. Thus, skirt 24 and insert 28 snugly receive between them rim 26 of container 12 when lid 22 is pressed onto said rim; this snug fit maintains lid 22 on rim 26 even when tab 38, discussed below, is pulled upwardly to form an exit opening that enables consumption of the beverage within the novel container. Thus, a seal is formed where the uppermost edge of rim 26 abuts the bottom surface of lid 22. Handle lid-removing means 34 having finger-receiving opening 35 is affixed by any suitable means to or is integrally formed with lid 22, on the peripheral edge thereof, in depending relation thereto as depicted. It enables a consumer to easily remove lid 22 if removal of said lid is desired. Lid 22 may also be provided with a perforated section 36 (FIGS. 1 and 4) that when removed by pulling upon tab 38 enables consumption of a beverage without requiring disengagement of the lid and container. Such perforated sections and pull tabs integral therewith are well known in the art and form no part of the invention, per se.

The eccentric mounting of lid-removing means 34 is novel. Even though the strength of the grip between the lid and container as provided by this invention is substantial, the peripheral mounting of said lid-removing means enables facile separation of container and lid.

Figure 5:
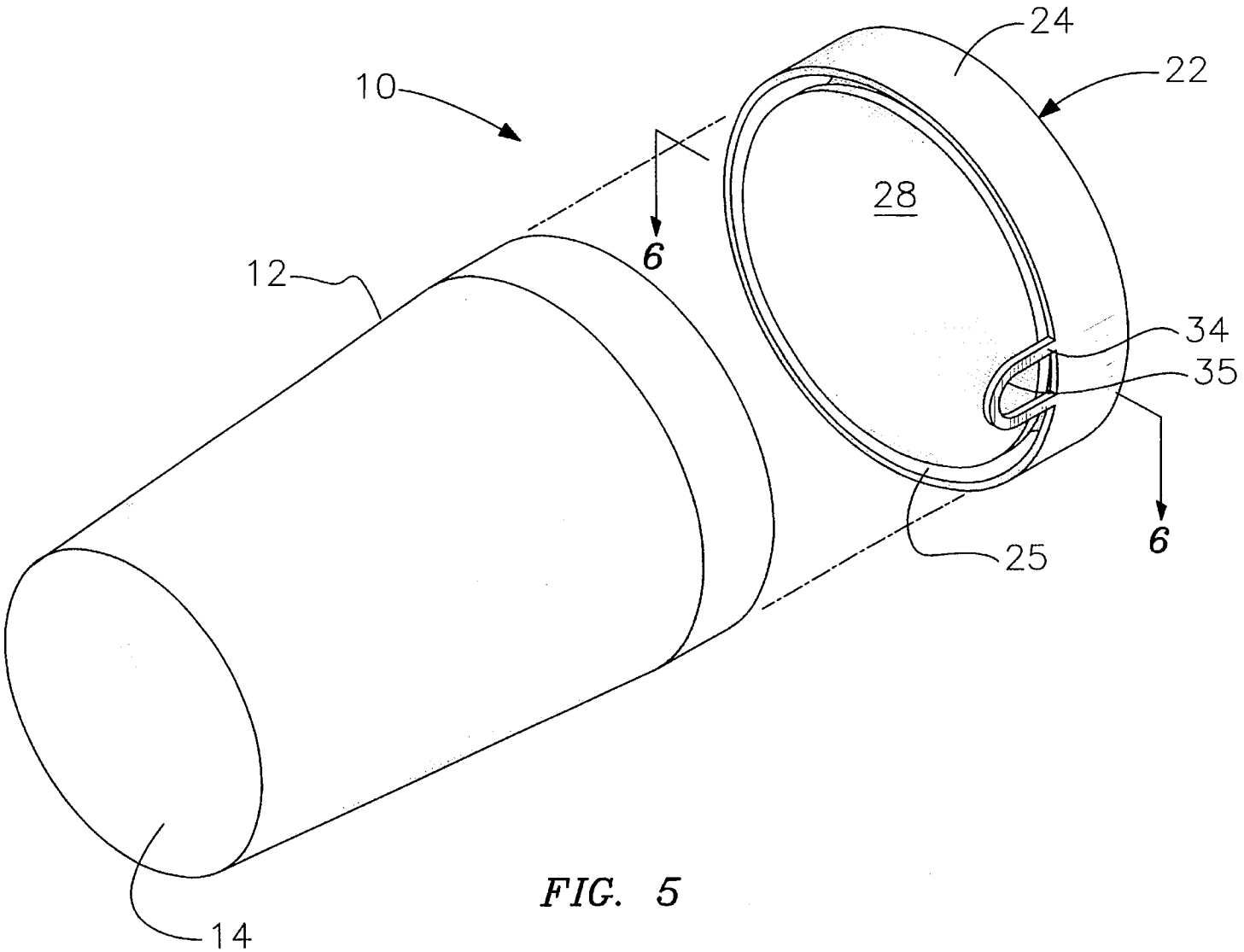
FIG. 5 is an exploded perspective view of a second embodiment of the invention.
Figure 6:
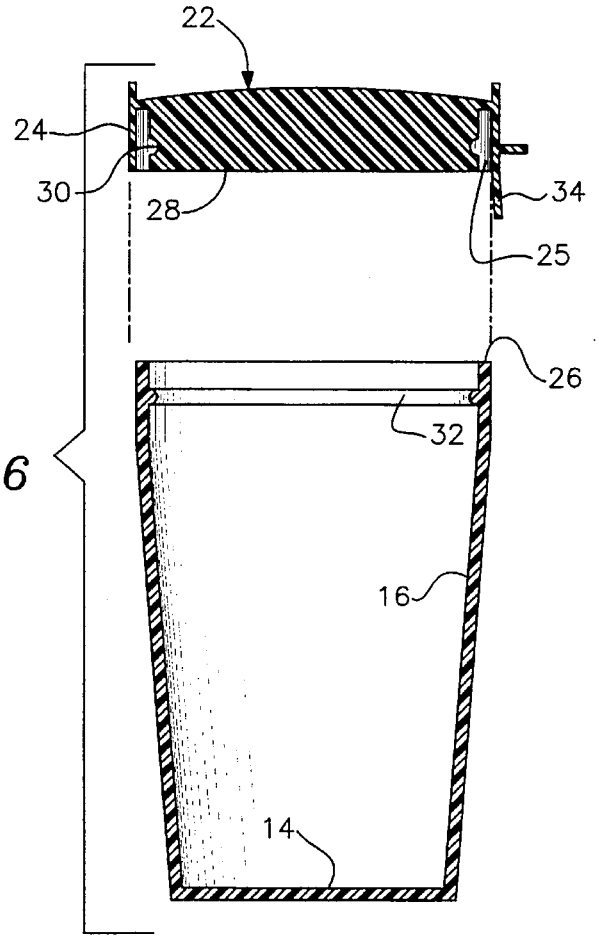
FIG. 6 is a sectional view taken along line 6—6 in FIG. 5.
Figure 7:
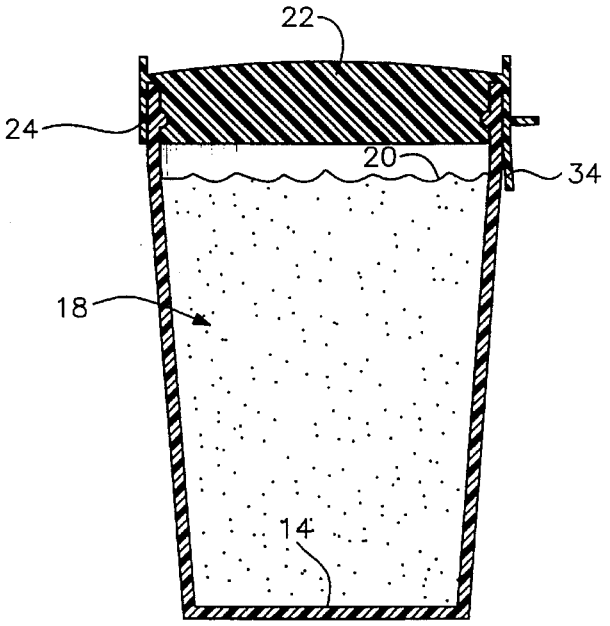
FIG. 7 is a sectional view of the container and lid of FIGS. 5 and 6 in their assembled configuration.

In a second embodiment, depicted in FIGS. 5–7, insert 28 is not provided in the form of an annular wall as in the first embodiment but instead is perhaps best described as a plug. However, the outer diameter thereof remains unchanged, i.e., it is still substantially equal to the inner diameter of rim 26. This increases the structural integrity of the assembly, but increases the amount of material required to make the lid.

Both embodiments include a double seal. The first seal is between groove 30 and ridge 32. The second seal is formed by the abutting engagement of rim 26 and the bottom of lid 22.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A lid and container combination, comprising:

a container having a bottom wall and a side wall mounted about a periphery of said bottom wall, said side wall projecting upwardly from said bottom wall, and a cavity defined collectively by said bottom wall and side wall;

a lid having a peripheral depending skirt for releasably engaging an outer surface of a rim of said container;

said peripheral depending skirt having an internal diameter substantially equal to an external diameter of said rim of said container;

an annular insert depending from said lid, said annular insert being spaced radially inwardly from said depending skirt by a distance substantially equal to a thickness of said rim of said container;

said insert having an external diameter substantially equal to an internal diameter of said rim of said container;

a groove of predetermined depth formed in an outer peripheral edge of said insert;

a protrusion formed in said side wall of said container, said protrusion extending radially inwardly toward a center of said container a predetermined distance substantially equal to the predetermined depth of said groove;

said lid and said container being made of a flexible, resilient material;

said depending skirt adapted to flex momentarily upon attachment of said lid to said container;

said depending skirt adapted to resume a position of repose upon full seating of said protrusion into said groove; and a first seal defined by said seating of said protrusion into said groove;

said protrusion being positioned a predetermined distance downwardly from said rim of said container; and a second seal being provided where said rim of said container abuts a bottom surface of said lid; and a lid-removing means attached to said lid to facilitate removal of said lid from said container, said lid-removing means being mounted to a peripheral edge of said lid in depending relation thereto; and said lid-removing means includes a finger-receiving opening.

* * * * *